US007901000B1

(12) United States Patent
Sorensen et al.

(10) Patent No.: US 7,901,000 B1
(45) Date of Patent: Mar. 8, 2011

(54) PEDESTAL CHAIR STORAGE ENCLOSURE

(76) Inventors: Steven L. Sorensen, Frankfort, IL (US); Dale R. Sorensen, Firestone, CO (US)

( * ) Notice: Subject to any disclaimer, the term of this patent is extended or adjusted under 35 U.S.C. 154(b) by 0 days.

(21) Appl. No.: 12/381,132

(22) Filed: Mar. 6, 2009

(51) Int. Cl.
*A47C 7/62* (2006.01)

(52) U.S. Cl. ..... 297/188.08; 297/188.12

(58) Field of Classification Search ..... 297/440.14, 297/440.1, 188.12, 188.2, 188.08, 188.01, 297/DIG. 6, 144, 147, 173
See application file for complete search history.

(56) References Cited

U.S. PATENT DOCUMENTS

| | | | | | |
|---|---|---|---|---|---|
| 3,780,468 | A | | 12/1973 | Maffett | |
| 3,929,375 | A | * | 12/1975 | Gans | 297/440.23 |
| 3,955,850 | A | * | 5/1976 | Toso | 297/440.14 |
| 4,023,304 | A | | 5/1977 | Singer | |
| 4,067,607 | A | | 1/1978 | Battles | |
| 4,266,707 | A | | 5/1981 | Rossman | |
| 4,474,291 | A | | 10/1984 | Fortson | |
| 4,662,303 | A | | 5/1987 | Duff | |
| 4,745,704 | A | * | 5/1988 | Schaefer | 43/54.1 |
| 4,791,752 | A | | 12/1988 | Van Kampen | |
| 4,887,379 | A | | 12/1989 | Harrison | |
| 5,112,103 | A | * | 5/1992 | Downer | 297/270.1 |
| 5,481,822 | A | * | 1/1996 | Engels | 43/54.1 |
| 5,577,458 | A | | 11/1996 | Kohl | |
| 5,657,573 | A | | 8/1997 | Fischer et al. | |
| 5,799,787 | A | | 9/1998 | Talbot | |
| D400,742 | S | | 11/1998 | Jackson | |
| 5,934,010 | A | | 8/1999 | Blackburn | |
| 6,045,193 | A | * | 4/2000 | Johnson | 297/423.41 |
| 6,550,613 | B2 | | 4/2003 | Amato | |
| 6,739,670 | B2 | * | 5/2004 | Johnson | 297/423.41 |
| 7,131,699 | B2 | * | 11/2006 | Mulmed | 297/440.14 |

* cited by examiner

*Primary Examiner* — Milton Nelson, Jr.
(74) *Attorney, Agent, or Firm* — Albert O. Cota

(57) ABSTRACT

A pedestal chair storage enclosure (10) that is designed to be placed and maintained below the seat (102) of a pedestal type chair (100). The storage enclosure (10) is comprised of a box section (12) having at least one, and preferably two, hinged doors (24,26) and a half-circle slot (28) that extends into the box section's rear surface (22). A plurality of trays (50) are located within the box section (12) and are accessible via the doors (24,26). The half-circle slot (28) allows the storage enclosure (10) to securely interface with the pedestal that supports the pedestal chair (100), thereby accommodating and maintaining the support enclosure (10) beneath the pedestal chair's seat (102).

13 Claims, 5 Drawing Sheets

PEDESTAL CHAIR STORAGE ENCLOSURE

TECHNICAL FIELD

The invention generally pertains to tackle boxes and similar storage enclosures, and more particularly to a portable modular storage enclosure that is designed to be placed and maintained below the seat of pedestal type chair.

BACKGROUND ART

The use of portable storage enclosures for transporting and maintaining various items has proven to be very effective. Storage enclosures provide protection for the items within, while also allowing quick and easy access to the items. One of the best examples of a portable storage enclosure is commonly known as a tackle box. Although tackle boxes were originally designed to transport and maintain various small items that are used by fishermen, such as lures, fishing line, etc., tackle boxes have also been widely used for other purposes, such as transporting and storing artist supplies, office supplies and other small items.

One problem that does persist when using a storage enclosure is where to place the enclosure. This problem is especially prevalent for tackle boxes that are taken on boats for fishing. There is often limited space on the deck of a boat and when there are several fishermen, each with their own tackle box, the problem is exacerbated.

Another reason that this problem is significant on boats is that boats commonly have pedestal type chairs. When a standard four-leg chair is present, it is often possible to place a storage enclosure beneath the chair. As a result of a pedestal chair's design it is difficult to place any item, let alone a storage enclosure, beneath a pedestal chair.

The obvious solution to this problem would be to design a storage enclosure that could be placed and maintained beneath a pedestal chair. One of the most important features though, would allow a person to normally and comfortably sit on a pedestal chair without any encumbrance from the storage enclosure located beneath the chair.

Although there are a relatively smaller number of pedestal chairs in use compared with conventional four-leg chairs, the benefits achieved by providing a storage enclosure that can be placed beneath a pedestal would still be significant.

A search of the prior art did not disclose any patents that read directly on the claims of the instant invention, however the following U.S. patents are considered related:

| Pat. No. | INVENTOR | ISSUED |
|---|---|---|
| 4,887,379 | Harrison | 19 Dec. 1989 |
| 5,577,458 | Kohl | 26 Nov. 1996 |
| 5,799,787 | Talbot | 1 Sep. 1998 |

The U.S. Pat. No. 4,887,379 patent discloses a fishing tackle box that is secured to the underside of a bass boat pedestal seat. A mounting structure permits the box to be pivoted relative to the seat between a latched stowage position in which the box is positioned entirely beneath and closely adjacent the underside of the seat, and a use position in which the box is positioned outwardly adjacent the side edge periphery of the seat. The mounting structure includes a pivotal mounting member intersecured between the seat and box, and a latch member pivotable between a latching position.

The U.S. Pat. No. 5,577,458 patent discloses a pedestal mounted seat storage base assembly for mounting on a pedestal base plate. The assembly comprises a storage base having a top and a bottom, a seat mounted on the storage base and a pedestal base plate adaptor mounted on the bottom of the storage base and configured for mounting on the pedestal base plate.

The U.S. Pat. No. 5,799,787 patent discloses a tackle box that includes a rotatable cover, one or more storage trays, a bottom tray and a central shaft for vertically stacking and mounting the storage tray or trays and a rotatable cover to the bottom tray. Access to the tackle box is made by rotating the cover and/or the storage trays. The side walls of the bottom tray and storage tray or trays in combination with the bottom tray floor and rotatable cover form the exterior surface of the tackle box. The number of storage trays that are included in the tackle box may be varied by changing a point of connection between the central shaft and the bottom tray.

For background purposes and as indicative of the art to which the invention is related reference may be made to the remaining patents located in the search:

| Pat. No. | INVENTOR | ISSUED |
|---|---|---|
| D400,742 | Jackson | 10 Nov. 1998 |
| 3,780,468 | Maffett | 25 Dec. 1973 |
| 4,023,304 | Singer | 17 May 1977 |
| 4,067,607 | Battles | 10 Jan. 1978 |
| 4,266,707 | Rossman | 12 May 1981 |
| 4,474,291 | Fortson | 2 Oct. 1984 |
| 4,662,303 | Duff | 5 May 1987 |
| 4,791,752 | Van Kampen | 20 Dec. 1988 |
| 5,657,573 | Fischer, et al | 19 Aug. 1997 |
| 5,934,010 | Blackburn | 10 Aug. 1999 |
| 6,550,613 | Amato | 22 Apr. 2003 |

DISCLOSURE OF THE INVENTION

In its preferred design, the pedestal chair storage enclosure (PCSE) is comprised of a box section having an upper surface, a lower surface, a right surface, a left surface, a rear surface, a right front door, a left front door, a half-circle slot that extends inward from the rear surface, an internal divider and hinge assemblies.

Located within the box section are a plurality of trays. Each tray has a front surface, a rear surface, a right surface, a left surface, a lower surface and a multiplicity of compartments. The trays are modular and dimensioned in multiples of a standard size, thereby allowing various combinations and numbers of multi-sized trays to be placed within the box section. The number of trays and the size of each tray can vary, depending on the particular application for which the PCSE is utilized. The trays are maintained within the box section by means of the hinge assemblies. The trays are accessed via the right front door and the left front door. Once either or both front doors are opened, each tray can be swung outward, thereby exposing the compartments within each tray.

In view of the above disclosure, the primary object of the invention is to provide a pedestal chair storage enclosure that allows quick and easy access to a variety of items which are placed within an enclosure that is located beneath the seat of a pedestal type chair.

In addition to the primary object of the invention, it is also an object of the invention to provide a pedestal chair storage enclosure that:

allows a wide variety of items to be stored and accessed,
allows two storage enclosures to be placed back-to-back beneath a single pedestal chair,
is especially effective for use as a tackle box for ship-mounted pedestal chairs,
can be made in various heights and widths to accommodate different styles and types of pedestal chairs,
provides a modular type storage system by utilizing easily replaceable trays of various sizes,
is strong and durable enough to provide years of use,
can be made in various colors for easy identification of ownership or items within,
is either made of a water-proof or water-resistant material,
is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment, with multiple design configurations, for a pedestal chair storage enclosure, (hereinafter "PCSE 10"). All of the design configurations of the PCSE 10 provide a modular storage enclosure that can be placed and maintained beneath the seat of a conventional pedestal type chair 100 having a support pedestal 102 that is attached to a horizontal surface and a seat 104.

Figure 2:
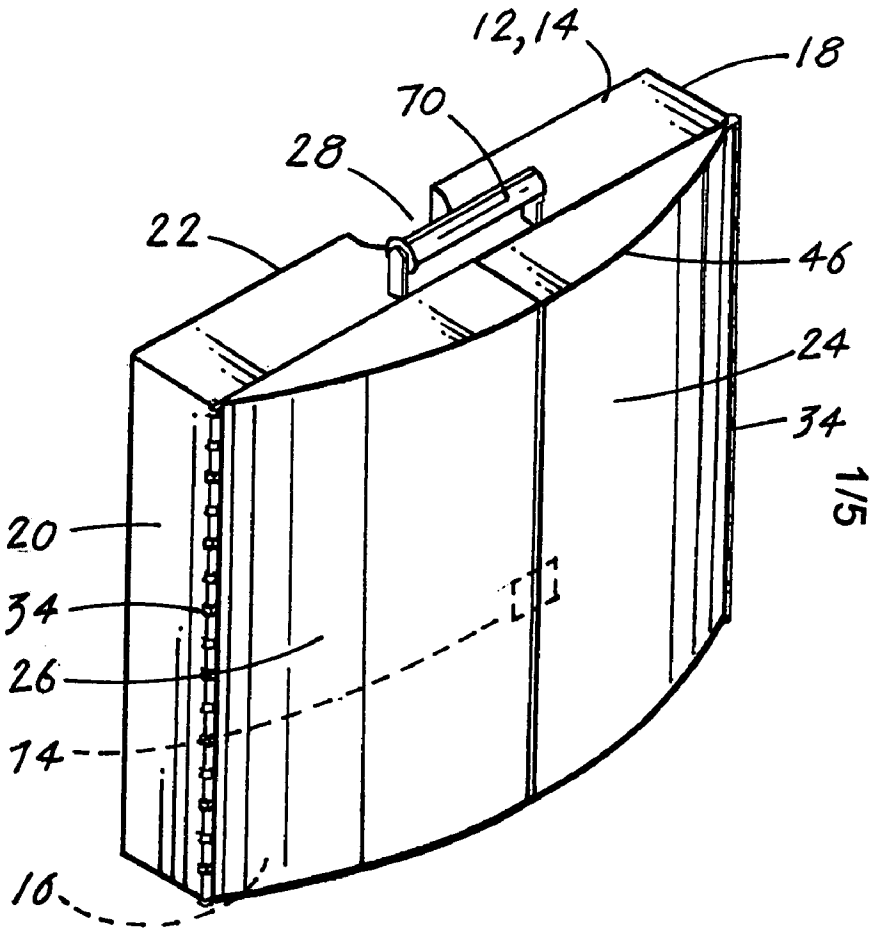
FIG. 2 is a perspective view of a pedestal chair storage enclosure removed from the pedestal chair and having two front doors shown in a closed position.
Figure 1:
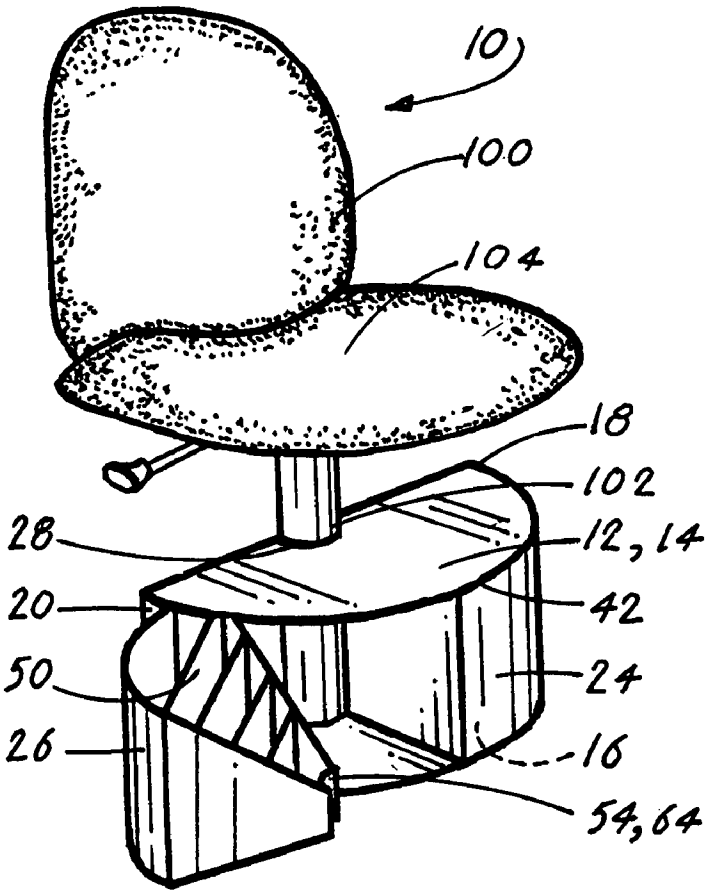
FIG. 1 is a perspective view of a pedestal chair storage enclosure placed beneath the seat of a conventional pedestal chair.

As shown in FIGS. 1 and 2, the preferred embodiment of the PCSE 10 is comprised of a box section 12 having an upper surface 14, a lower surface 16, a right surface 18, a left surface 20, a rear surface 22, a right front door 24, a left front door 26, a half-circle slot 28, an internal divider 30 and hinge assemblies 34.

Figure 3:
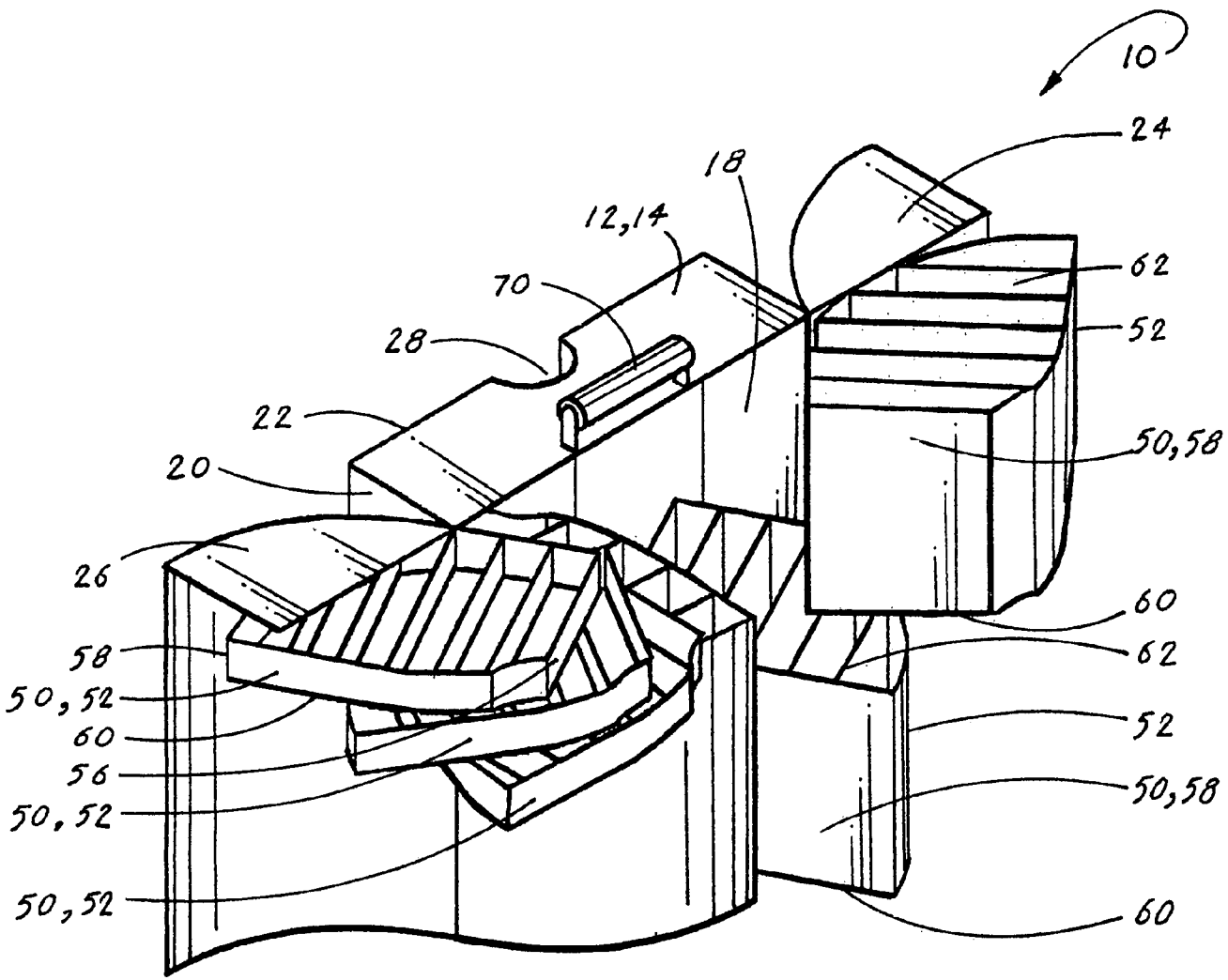
FIG. 3 is a perspective view of a pedestal chair storage enclosure removed from the pedestal chair and having two front doors that are shown in an open position.
Figure 4:
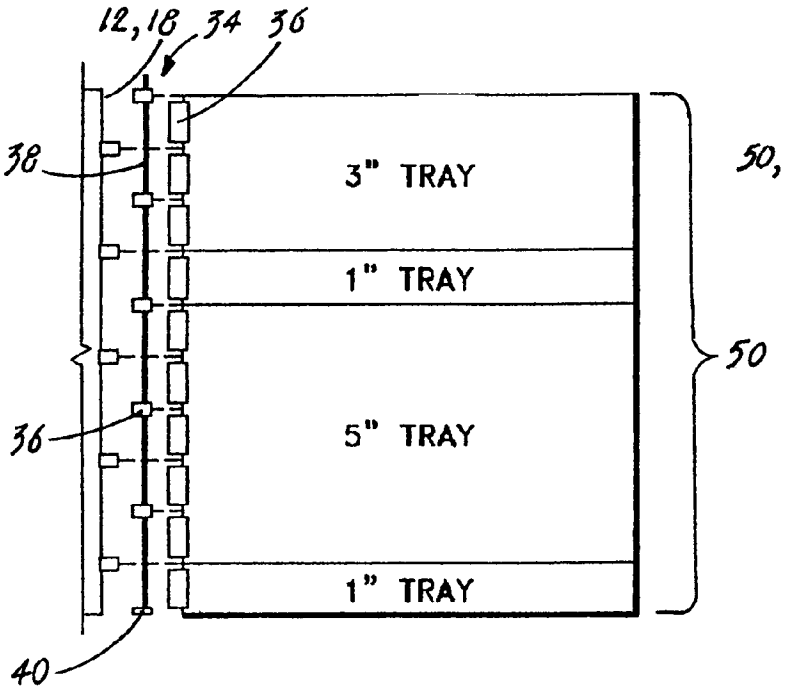
FIG. 4 is a partial front elevational view of a pedestal chair storage enclosure having a plurality of trays that are dimensioned in multiplies of a standard size and that are attached by a hinge assembly.
Figure 10:
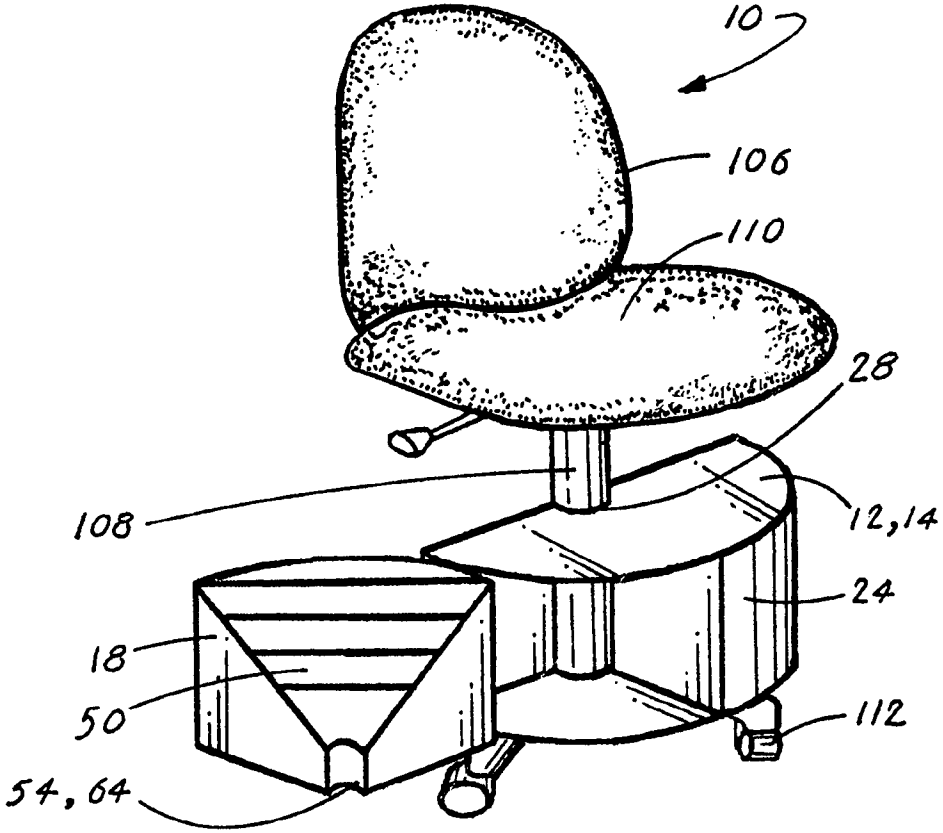
FIG. 10 is a perspective view of a pedestal chair storage enclosure placed beneath the seat of a pedestal type office chair.

Located within the box section 12 are a plurality of trays 50. As shown in FIG. 3, each tray 50 is comprised of a front surface 52, a rear surface 54, a right surface 56, a left surface 58, a lower surface 60 and a multiplicity of horizontal or vertical compartments 62 that preferably extend downward into each tray 50. As shown in FIG. 4, the trays 50 are dimensioned in multiples of a standard size, thereby allowing various combinations and numbers of multi-sized trays 50 to be placed within the box section 12. The number of trays 50 and the size of each tray can vary, depending on the particular application for which the PCSE 10 is utilized. As shown in FIGS. 1 and 10, an arc slot corner 64 is located at the rear surface 54 of each tray 50 to allow the trays to interface with the pedestal chair's 100,106 pedestal 102,108. The trays 50 are maintained within the box section 12 by means of the hinge assemblies 34.

Figure 5:
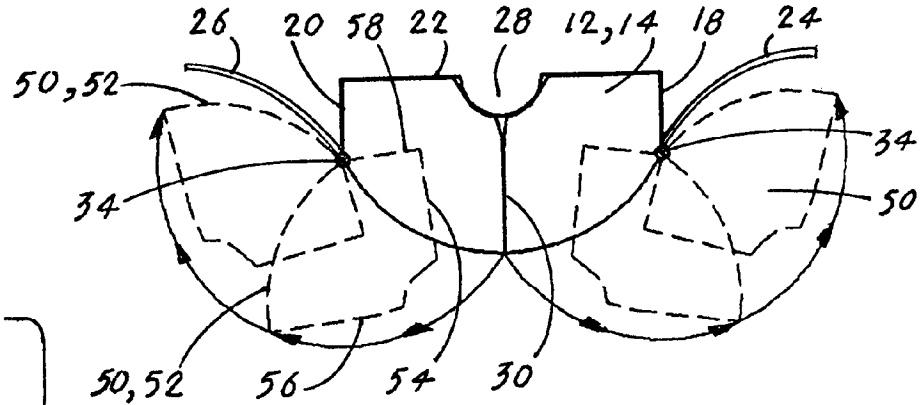
FIG. 5 is a top plan view showing two doors and a plurality of trays located side-by-side and that are separated by an internal divider.

The hinge assemblies 34 in the preferred embodiment, as shown in FIG. 4, are comprised of a plurality of equi-spaced tubes 36 that extend vertically along the right surface, front edge of the box section 12, the left surface, front edge of the box section 12, the right edge of the right front door 24, the left edge of the left front door 26, the right surface 56 of each right side tray 50 and the left surface 58 of each left side tray 50. As shown in FIG. 5, this arrangement of doors and trays provides the PCSE 10 with two sets of trays 50 that are located side-by-side. The internal divider 30 separates the two sets of trays 50, as also shown in FIG. 5.

Once the two front doors 24,26 and all the trays 50 are aligned on and in the box section 12, a hinge pin 38 is inserted sequentially through each equi-spaced tube 36, as shown in FIG. 4, thereby connecting each side's respective door and trays to the box section 12. The hinge assemblies 34 facilitate the quick and easy removal and replacement of the various multi-sized trays 50 from within the box section. If desired, a securing means such as a lock screw 40 can be utilized to maintain each hinge pin 38 in position.

As shown in FIG. 3, the trays 50 are accessed via the right front door 24 and the left front door 26. When either front door is opened, each tray 50 can be swung outward thereby exposing the compartments 62 within each tray 50.

As also shown in FIG. 1, the right front door 24, the left front door 26, and the front surface 52 of each tray 50 are radiused outward in a shape that corresponds to the radius of the pedestal chair's seat 104. As shown in FIG. 2, at least one door lock/latch 74 can be utilized to maintain a door in a closed position.

The PCSE 10 is preferably made of a plastic material, although other materials such as a treated wood, a treated metal, stainless steel or anodized aluminum can also be utilized. The wood and metal are treated to protect against deterioration and rust which occur as a result of being exposed to moisture. This is especially important when the PCSE 10 is used as a tackle box, which will typically be the primary use since pedestal chairs are prevalent on boats.

Figure 6:
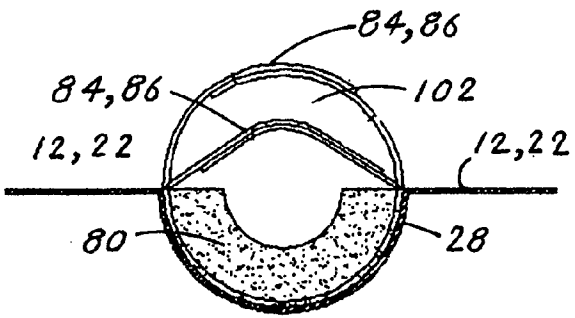
FIG. 6 is a top plan view and cross-sectional view showing a half-circle slot having foam padding and a hook and loop fastener securing means for the pedestal chair storage enclosure.

As shown in FIG. 1, the half-circle slot 28 that extends inward from the box section's rear surface 22 allows the PCSE 10 to be placed almost completely beneath the seat 104 of a pedestal chair 100. If desired, foam padding 80, as shown in FIG. 6, can be attached to the outer surface of the half-circle slot 28 to provide a cushion where the PCSE 10 interfaces with the pedestal 102.

Figure 7:
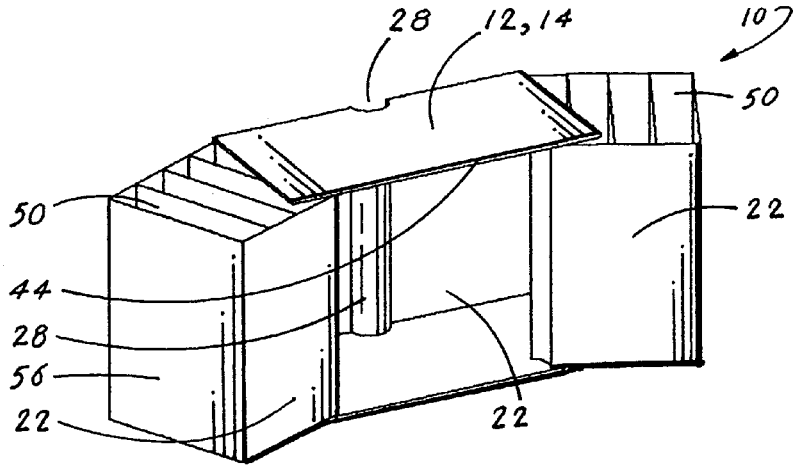
FIG. 7 is a perspective view of a pedestal chair storage enclosure having a rectangular shape.

The preferred embodiment of the PCSE 10, as previously disclosed, has a shape with a radiused front that corresponds to the radius of a pedestal chair's seat 104. In the other design configurations, the PCSE 10 can have a round shape 42, as shown in FIG. 1; an oval shape 46, as shown in FIG. 2; or a rectangular shape 44, as shown in FIG. 7.

For all the design configurations, the PCSE 10 can also include a handle 70, as shown in FIG. 2, that extends upward form the upper surface 14. If desired, a pair of handles 70, with one handle on each side can also be utilized.

The PCSE 10 can also comprise securing means 84 for securing the PCSE 10 to a pedestal chair 100.

Figure 8:
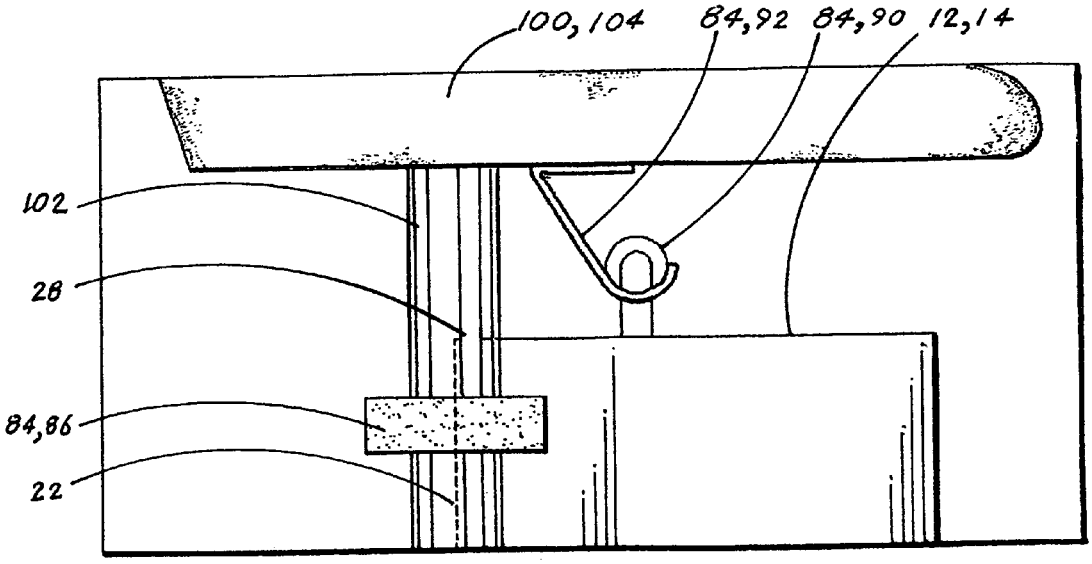
FIG. 8 is a side elevational view of a pedestal chair storage enclosure attached to a seat by a securing means consisting of a hook and an eyelet or a hook and loop fastener.

As shown in FIGS. 6 and 8, one embodiment of the securing means 84 is comprised of a hook and loop fastener 86, also known as VELCRO®, that is attached to the PCSE's 10 rear surface and that is wrapped around the pedestal of the pedestal chair 100.

In another embodiment, the securing means 84 is comprised of a combination eyelet 90 and hook 92. As shown in FIG. 8, the eyelet 90 is attached to the PCSE's 10 upper surface, and the hook 92 is attached to the lower surface of the pedestal chair's seat 102. The hook 90 is inserted through the eyelet 90, thereby securing the PCSE 10 to the pedestal chair 100 and allowing the PCSE 10 to turn along with the pedestal chair 100.

A similar embodiment of the securing means 84 utilizes a hook 92 that extends downward from the lower surface of the pedestal chair's seat 104. The hook 92 is then inserted around the handle 70 that extends upward form the PCSE's 10 upper surface.

Figure 9:
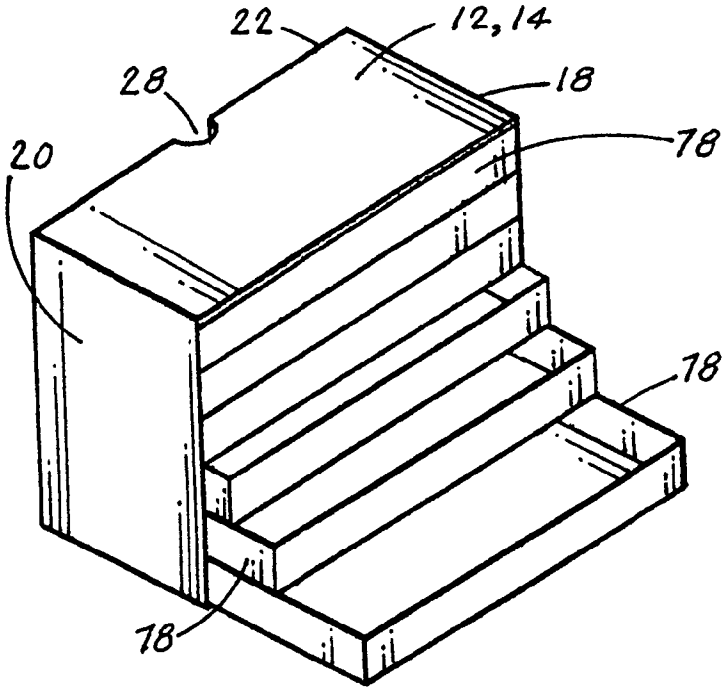
FIG. 9 is a perspective view of a pedestal chair storage enclosure having a plurality of horizontal drawers.

In another design configuration of the PCSE 10, the plurality of trays 50 located within the box section 12 are replaced with a plurality of horizontal drawers 78. As shown in FIG. 9, each of the drawers 78 can be pulled outward from the front of the box section 12.

And, in a final design configuration, the PCSE 10 is placed and maintained beneath the seat 110 of a pedestal type office chair 106, as shown in FIG. 10. The basic design and functionally of the final design configuration of the PCSE 10 is the same as the preferred embodiment, with two exceptions. First, the storage enclosure is placed upon and supported by at least one of a plurality of legs 112 that laterally extend outward form the lower end of the pedestal 108 that supports the office chair 106. Second, the trays 50 are dimensioned to accept and store office supplies, such as multi-sized papers, writing utensils, paper clips, tape, etc.

The securing means for securing the storage enclosure to the pedestal type office chair are the same as those in the preferred embodiment.

An additional design, which is applicable to all the configurations of the PCSE 10, is to utilize two storage enclosures beneath a single chair 100. The two storage enclosures are placed back-to-back, which creates 360 degrees of rotatable storage space.

Regardless of which design configuration is utilized, the functionality remains the same and the primary goal of providing a storage enclosure that can be placed and maintained beneath the seat 104 of a pedestal chair 100 is accomplished.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A pedestal chair storage enclosure for use with a pedestal type chair, wherein said storage enclosure is designed to be placed and maintained below the seat of a conventional pedestal type chair, wherein said storage enclosure comprises:

a) a box section having an upper surface, a lower surface, a right surface, a left surface, a rear surface, a right front door, a left front door, a half-circle slot extending inward from the rear surface, that interfaces with the pedestal supporting said pedestal type chair, an internal divider and hinge assemblies, and b) a plurality of trays, with each tray having a front surface, a rear surface, a right surface, a left surface, a lower surface, and a multiplicity of compartments that extend downward into each tray, wherein said trays are dimensioned in multiples of a standard size, thereby allowing various combinations and numbers of multi-sized trays to be placed within said box section, wherein said trays are maintained within said box section by means of the hinge assemblies, wherein said trays are accessed via the right front door and the left front door, wherein once either front door is opened, each said tray can be swung outward thereby exposing the compartments within each tray.

2. A pedestal chair storage enclosure for use with a pedestal type chair, wherein said storage enclosure is designed to be placed and maintained below the seat of a conventional pedestal type chair, wherein said storage enclosure comprises:

a) a box section having an upper surface, a lower surface, a right surface, a left surface, a rear surface, a right front door, a left front door, a half-circle slot that is dimensioned to accept the pedestal that supports said pedestal chair and that extends inward from the rear surface that interfaces with the pedestal supporting said pedestal type chair, an internal divider and hinge assemblies, and b) a plurality of trays, with each tray having a front surface, a rear surface, a right surface, a left surface, a lower surface, and a multiplicity of compartments that extend downward into each tray, wherein said trays are dimensioned in multiples of a standard size, thereby allowing various combinations and numbers of multi-sized trays to be placed within said box section, wherein said trays are maintained within said box section by means of the hinge assemblies, wherein said trays are accessed via the right front door and the left front door, wherein once either front door is opened, each said tray can be swung outward thereby exposing the compartments within each tray.

3. The pedestal chair storage enclosure as specified in claim 2 wherein said plurality of trays are replaced with a plurality of horizontal drawers, each of which may be pulled outward from the front of said box section.

4. The pedestal chair storage enclosure as specified in claim 2 wherein said front doors are integral with said plurality of trays.

5. The pedestal chair storage enclosure as specified in claim 2 further comprising foam padding that is attached to the outer surface of the half-circle slot, wherein the foam padding provides a cushion where said storage enclosure interfaces with the pedestal.

6. The pedestal chair storage enclosure as specified in claim 2 further comprising securing means for securing said storage enclosure to the pedestal chair.

7. The pedestal chair storage enclosure as specified in claim 2 wherein said right front door, said left front door and the front surface of each said tray are radiused outward in a shape that corresponds to the radius of a pedestal chair's seat.

8. The pedestal chair storage enclosure as specified in claim 2 wherein said storage enclosure is made of a material that is selected from the group consisting of a plastic, a treated wood, a treated metal, stainless steel and anodized aluminum.

9. The pedestal chair storage enclosure as specified in claim 2 wherein said storage enclosure has a shape that is selected from the group consisting of round, square and oval.

10. The pedestal chair storage enclosure as specified in claim 2 wherein the internal divider separates said plurality of trays into right side trays and left side trays.

11. The pedestal chair storage enclosure as specified in claim 2 wherein each said hinge assembly is comprised of a plurality of equi-spaced tubes extending vertically along a right surface front edge of said box section, a left surface front edge of said box section, a right edge of the right front door, a left edge of the left front door, a right surface of each right side tray and a left surface of each left side tray, wherein once the two front doors and all the trays are aligned on and in said box section, a hinge pin is inserted sequentially through each equi-spaced tube, thereby connecting each side's respective door and trays to said box section, wherein said hinge assemblies facilitate a quick and easy removal and replacement of said multi-sized trays from within said box section, wherein each said hinge assembly is further comprised of a lock screw that is utilized to maintain the hinge pin in place.

12. The pedestal chair storage enclosure as specified in claim 2 further comprising at least one door lock/latch that is utilized to maintain a door in a closed position.

13. The pedestal chair storage enclosure as specified in claim 2 further comprising a handle that extends upward from the upper surface of said storage enclosure.

* * * * *